US008636525B2

(12) United States Patent
Sobig et al.

(10) Patent No.: US 8,636,525 B2
(45) Date of Patent: Jan. 28, 2014

(54) APPARATUS HAVING A MOVABLE USER INPUT DEVICE INCLUDING AN ACTUATABLE PORTION

(75) Inventors: Tim Sebastian Sobig, Ulm (DE); Victor Barend Burger, Ulm (DE); Juha Tauriainen, Ulm (DE)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 13/422,398

(22) Filed: Mar. 16, 2012

(65) Prior Publication Data

US 2013/0244460 A1 Sep. 19, 2013

(51) Int. Cl.
*H01R 13/44* (2006.01)

(52) U.S. Cl.
USPC ..... 439/136

(58) Field of Classification Search
USPC ..... 439/135–144
See application file for complete search history.

(56) References Cited

U.S. PATENT DOCUMENTS

| | | | | |
|---|---|---|---|---|
| 6,933,927 | B2 | 8/2005 | Lu | 345/169 |
| 6,975,274 | B2 * | 12/2005 | Sanchez et al. | 343/702 |
| 7,340,284 | B2 * | 3/2008 | Chung | 455/569.1 |
| 7,341,464 | B2 * | 3/2008 | Cuellar et al. | 439/135 |
| 7,547,218 | B2 * | 6/2009 | Hiew et al. | 439/135 |
| 7,946,866 | B2 * | 5/2011 | Bernstein et al. | 439/136 |
| 7,991,433 | B2 * | 8/2011 | Mellage et al. | 455/557 |
| 8,029,299 | B1 * | 10/2011 | Huang | 439/135 |
| 8,267,780 | B2 * | 9/2012 | Yoshino et al. | 463/32 |
| 2004/0137960 | A1 | 7/2004 | Chung | 455/569.2 |
| 2007/0155249 | A1 | 7/2007 | Cheng | 439/668 |
| 2009/0185045 | A1 | 7/2009 | Rosenblatt et al. | 348/222.1 |
| 2010/0078343 | A1 | 4/2010 | Hoellwarth et al. | 206/320 |

FOREIGN PATENT DOCUMENTS

| | | |
|---|---|---|
| CN | 201388245 | 1/2010 |

OTHER PUBLICATIONS

"It's Time to Kiss that Removable Smartphone Battery Goodbye", Feb. 2, 2012; (http://snowbirdcomputers.blogspot.com/2012/02/its-time-to-kiss-that-removable.html.

"Asus Eee Pad Transformer TF101G Review", Roydon Cerejo, Nov. 5, 2011; (http://tech2.In.com/reviews/tablets/asus-eee-pad-transformer-tf101g-review/254912).

* cited by examiner

*Primary Examiner* — Chandrika Prasad
(74) *Attorney, Agent, or Firm* — Harrington & Smith

(57) ABSTRACT

According to embodiments of the disclosure there is provided an apparatus including a user input device; and a mechanism configured to enable the user input device to be moved between a first position and a second position wherein when the user input device is in the first position a socket is accessible by a user of the apparatus and when the user input device is in the second position the socket is not accessible by the user of the apparatus.

16 Claims, 4 Drawing Sheets

APPARATUS HAVING A MOVABLE USER INPUT DEVICE INCLUDING AN ACTUATABLE PORTION

TECHNOLOGICAL FIELD

Embodiments of the present invention relate to an apparatus comprising a user input device. In particular, they relate to an apparatus comprising a user input device wherein the user input device is provided in the surface of a casing of the apparatus.

BACKGROUND

Apparatus, such an electronic apparatus, are known to have user input devices which enable a user to control the apparatus. It is useful to provide the user input device in a location which is easily accessible by a user, for example on the surface of a casing of the apparatus. In small apparatus the space available for user input devices may be limited.

BRIEF SUMMARY

According to some, but not necessarily all embodiments of the disclosure there is provided, an apparatus comprising: a user input device; and a mechanism configured to enable the user input device to be moved between a first position and a second position wherein when the user input device is in the first position a socket is accessible by a user of the apparatus and when the user input device is in the second position the socket is not accessible by the user of the apparatus.

In some embodiments the user input device may be configured to enable a user input to control at least one function of the apparatus.

In some embodiments the user input device may comprise a key.

In some embodiments the mechanism configured to enable the user input device to be moved between a first position and a second position may be configured to couple the user input device to the apparatus.

In some embodiments the mechanism configured to enable the user input device to be moved between a first position and a second position may comprise a flexible member.

In some embodiments the mechanism configured to enable the user input device to be moved between a first position and a second position may comprise a hinge.

In some embodiments the mechanism configured to enable the user input device to be moved between a first position and a second position may comprise a sliding mechanism.

In some embodiments when the user input device is in the second position the user input device may form part of a surface of a casing of the apparatus.

In some embodiments the user input device may form a continuous surface with the casing of the apparatus.

In some embodiments the socket may comprise a cavity configured to receive at least part of a further apparatus. The further apparatus may comprise a storage device. The storage device may comprise a memory card.

In some embodiments the further apparatus may comprise a cable and the socket may be configured to receive a connecting portion of the cable.

The apparatus may be for wireless communication.

BRIEF DESCRIPTION

For a better understanding of various examples of embodiments of the present disclosure reference will now be made by way of example only to the accompanying drawings in which:

FIG. 1 schematically illustrates an exemplary apparatus according to an embodiment of the disclosure;

FIG. 2 schematically illustrates an exemplary apparatus according to another embodiment of the disclosure;

DETAILED DESCRIPTION

The Figures illustrate an apparatus 1 comprising a user input device 15; and a mechanism 31 configured to enable the user input device to be moved between a first position and a second position wherein when the user input device 15 is in the first position a socket 33 is accessible by a user of the apparatus 1 and when the user input device is in the second position the socket 33 is not accessible by the user of the apparatus 1.

Figure 1:
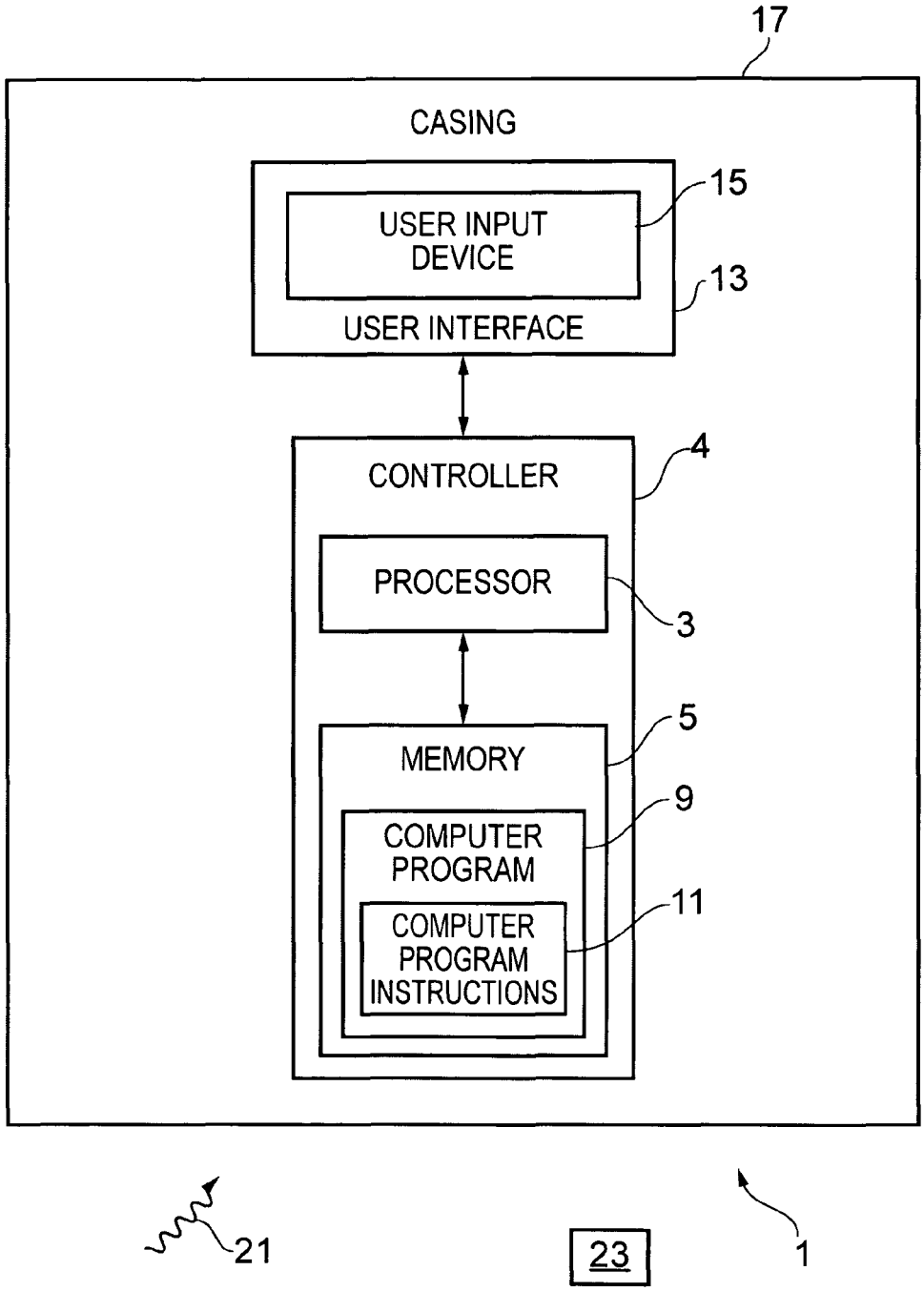

FIG. 1 schematically illustrates an apparatus 1 according to an embodiment of the disclosure. The apparatus 1 may be an electronic apparatus. The apparatus 1 may be, for example, a mobile cellular telephone, a tablet computer, a personal computer, a camera, a gaming device, a personal music player, an electronic book reader or any other apparatus which comprises a user input device 15 and which may be configured to be connected to another apparatus. The apparatus 1 may be a handheld apparatus 1 which can be carried in a user's hand, handbag or pocket of their clothing for example.

Figure 2:
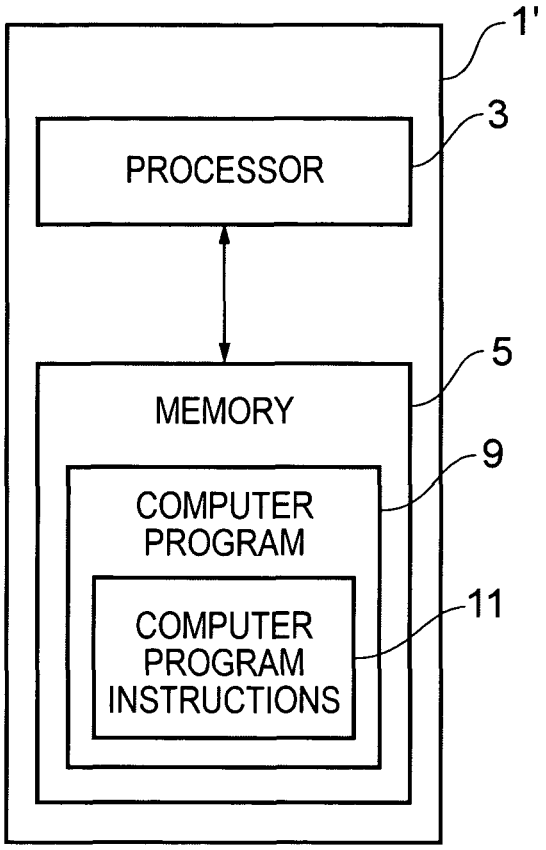

Only features of the apparatus 1 referred to in the following description are illustrated in FIGS. 1 and 2. However, it should be understood that the apparatus 1 may comprise additional features that are not illustrated. For example, in embodiments where the apparatus 1 is configured to enable communication or wireless communication the apparatus 1 may also comprise one or more transmitters and receivers.

The exemplary apparatus 1 illustrated in FIG. 1 comprises: a user interface 13 and a controller 4. In the illustrated exemplary embodiment the controller 4 comprises at least one processor 3 and at least one memory 5 and the user interface 13 comprises at least a user input device 15. The controller 4 and user interface 13 may be located within a casing 17.

The controller 4 and user interface 13 may be operationally coupled. It is to be appreciated that any number or combination of intervening elements may be provided between the respective components of the apparatus 1 including no intervening elements.

The controller 4 provides means for controlling the apparatus 1. The controller 4 may be implemented using instructions that enable hardware functionality, for example, by using executable computer program instructions 11 in one or more general-purpose or special-purpose processors 3 that may be stored on a computer readable storage medium 23 (e.g. disk, memory etc) to be executed by such processors 3.

The at least one processor 3 may be configured to receive input commands from the user interface 13 and also to provide output commands to the user interface 13. In response to an input command received from the user interface 13 the at least one processor 3 may be configured to control the apparatus 1 to perform a function corresponding to the received input command.

The at least one processor 3 is also configured to write to and read from the at least one memory 5. Outputs of the user interface 13 are provided as inputs to the controller 4.

In the exemplary embodiment of the disclosure schematically illustrated in FIG. 1 the user interface comprises a user input device 15. The user input device 15 may comprise any means which enables a user input to be detected. The detection of a user input may enable the user of the apparatus 1 to input information which may be used to control the apparatus 1. The user input device 15 may comprise a key, a keypad, a touch pad, a touch sensitive display or a combination of a number of different types of user input devices.

The output of the user input device 15 may be provided as an input to the controller 4. The output of the user input device 15 may depend upon the type of actuation of the user input device 15 and also the location of the user input device 15 which has been actuated by the user input. The controller 4 may be configured to determine the type of input which has been made and also the location of the user input and enable the appropriate function to be performed in response to the detected input.

In some embodiments of the apparatus the user interface 13 may also comprise means for providing an output to a user of the apparatus. For example, the user interface 13 may comprise a display such as a touch sensitive display which may comprise any means which enables information to be displayed to a user of the apparatus 1. In some embodiments the user interface 13 may comprise means for providing an audio output to a user such as a loudspeaker.

The at least one memory 5 may be configured to store a computer program code 9 comprising computer program instructions 11 that control the operation of the apparatus 1 when loaded into the at least one processor 3. The computer program instructions 11 provide the logic and routines that enable the apparatus 1 to perform methods to implement embodiments of the disclosure. The at least one processor 3 by reading the at least one memory 5 is able to load and execute the computer program 9.

The computer program instructions 11 may provide computer readable program means configured to control the apparatus 1.

The computer program code 9 may arrive at the apparatus 1 via any suitable delivery mechanism 21. The delivery mechanism 21 may be, for example, a computer-readable storage medium, a computer program product 23, a memory device, a record medium such as a CD-ROM or DVD, an article of manufacture that tangibly embodies the computer program code 9. The delivery mechanism may be a signal configured to reliably transfer the computer program code 9. The apparatus 1 may propagate or transmit the computer program code 9 as a computer data signal.

Although the memory 5 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (e.g. Von Neumann)/parallel architectures but also specialized circuits such as field-programmable gate arrays (FPGA), application integration specific circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

The apparatus 1 illustrated in FIG. 1 also comprises a casing 17. The casing may 17 provide an external housing for the apparatus 1. The components of the apparatus 1, which are illustrated schematically in FIG. 1 may be contained within the casing 17. Some of the components of the apparatus 1, such as the user input device 15 may be provided on the surface of the casing 17. The casing 17 may provide protection for the components of the apparatus 1. For example, the casing 17 may protect the components of the apparatus 1 from atmospheric conditions such as moisture or temperature variations. The casing 17 may also be configured to protect the components of the apparatus 1 from mechanical shocks.

FIG. 2 illustrates an apparatus 1' according to another embodiment of the invention. The apparatus 1' illustrated in FIG. 2 may be a chip or a chip-set. The apparatus 1' comprises at least one processor 3 and at least one memory 5 as described above in relation to FIG. 1.

Figure 3A:
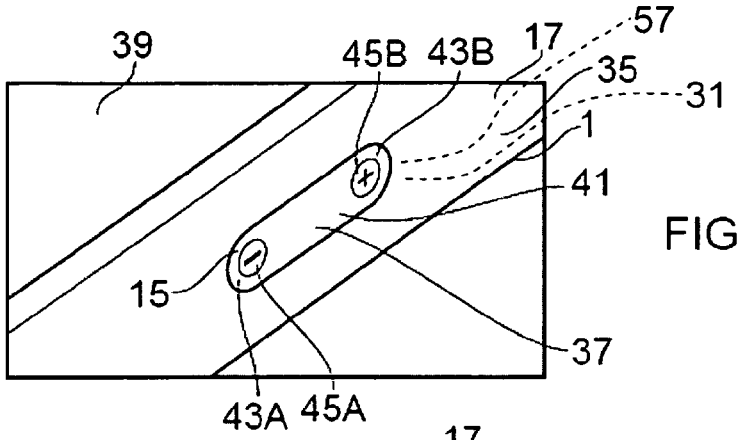
FIGS. 3A and 3B illustrate an apparatus according to a first exemplary embodiment of the disclosure.
Figure 3B:
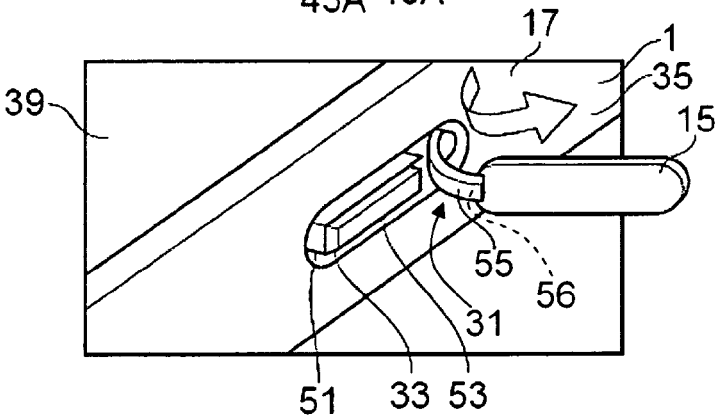

FIGS. 3A and 3B illustrate an example apparatus 1 according to a first embodiment of the disclosure. In FIG. 3A the user input device 15 is located in a closed position and in FIG. 3B the user input device 15 is located in an open position.

In the exemplary embodiments of FIGS. 3A and 3B the user input device 15 forms part of the casing 17 of the apparatus 1. When the user input device 15 is configured in the closed position, as illustrated in FIG. 3A, the user input device 15 forms part of the surface 35 of the casing 17. In the particular embodiment of FIG. 3A the surface 37 of the user input device 15 forms part of the surface 35 of the casing 17. The surface 37 of the user input device 15 may be level with the surface 35 of the casing 17 so that the two surfaces 35, 37 are at the same height. This may enable the two surfaces 35, 37 to form a continuous plane.

The user input device 15 may be provided in any location of the casing 17 which is convenient for a user to access. In the exemplary embodiment illustrated in FIGS. 3A and 3B the user input device 15 is provided on a side edge of the casing 17 of the apparatus 1. Other user input devices, such as a touch sensitive display 39, may be provided on a front face of the casing 17 of the apparatus 1.

The user input device 15 may comprise any means configured to detect a user input and enable user control of the apparatus 1. In the exemplary embodiment of FIGS. 3A and 3B the user input device 15 comprises a key 41. The key 41 may comprise a push-button which may be depressed when a force is applied by a user of the apparatus 1. The user input device 15 may be configured to detect depression of the key 41 and provide an output signal indicative of the detected depression. For example, in some embodiments of the disclosure, depressing the key 41 may cause an electric circuit to be completed and so may enable an output signal to be provided.

In some embodiments of the disclosure the key 41 may be configured to provide different output signals depending on the way in which the user input device 15 is actuated. For example, the user may be able to make a long press or short press actuation and so the output signal provided may be indicative of whether a short press or long press actuation has been made.

In the exemplary embodiments illustrated in FIGS. 3A and 3B the key 41 is sized and shaped so as to provide a cover for the socket 33. In the illustrated embodiment the key 41 has an elongate shape so that the key 41 has a length greater than the width. It is to be appreciated that other shaped keys 41 or different types of user input device 15 could be used in other embodiments of the disclosure.

The exemplary key 41 key illustrated in FIGS. 3A and 3B has two actuatable portions 43A, 43B. The actuatable portions 43A, 43B are configured to provide an output signal to the controller 4 in response to actuation. In the illustrated embodiment a first actuatable portion 43A is provided at a first end of the key 41 and a second actuatable portion 43B is provided at the second end of the key 41. The function which is enabled in response to actuation of the key may depend on which actuatable portion 43A, 43B has been actuated.

In the exemplary embodiments illustrated in FIGS. 3A and 3B the key 41 is a volume key. Actuation of the volume key enables the volume of an audio output, provided by the apparatus 1 to be controlled.

Two indicia 45A, 45B are marked on the key 41. The indicia 45A, 45B may provide an indication of the location of the actuatable portions 43A, 43B and the functions associated with the actuatable portions 43A, 43B. In the specific embodiment of FIGS. 3A and 3B the first indicia 45A comprises a minus sign and indicates that if this portion of the key 41 is actuated the volume of the audio output will decrease. The second indicia 45B comprises a plus sign and indicates that if this portion of the key 41 is actuated the volume of the audio output will increase.

In FIG. 3A the user input device 15 is illustrated in a closed position. When the user input device 15 is in the closed position the user input device 15 provides a cover for a socket 33 so that the socket is not accessible to the user of the apparatus 1. As the socket 33 is covered in the configuration illustrated in FIG. 3A the socket 33 is not illustrated in FIG. 3A.

When the user input device 15 is in the closed position a seal maybe provided around the boundary between the edge user input device 15 and the edge of the socket 33 of the apparatus 1. The seal may protect the apparatus 1 from fluid ingress.

FIG. 3B illustrates the same apparatus 1 illustrated in FIG. 3A however in FIG. 3B the user input device 15 has been moved to an open configuration so that the socket 33 is now accessible to a user of the apparatus 1.

The socket 33 may comprise a cavity 51 within the casing 17 of the apparatus 1. The cavity 51 may be configured to receive at least part of a further apparatus.

In some embodiments of the disclosure the further apparatus may comprise a storage device such as a memory card. In such embodiments the cavity 51 may have a size and shape such that a storage device can fit within the cavity 51. The socket 33 may also comprise a connector 53. The connector 53 may comprise any means for coupling the storage device to the apparatus 1 so that data can be transferred between the storage device and the apparatus 1.

In some embodiments of the disclosure the further apparatus may comprise a cable or other means which enables a physical connection between the apparatus 1 and another apparatus. For example the cable may comprise a USB (Universal serial bus) cable. The cable may comprise a connecting portion. In such embodiments the cavity 51 may have a size and shape such that a connecting portion of the cable can fit within the cavity 51. The socket 33 may also comprise a connector 53. The connector 53 may comprise any means for coupling the storage device to the apparatus 1 so that data can be transferred between the cable and the apparatus 1.

When the apparatus 1 is in the open configuration as illustrated in FIG. 3B the socket 33 is accessible to the user of the apparatus 1 so that the user of the apparatus 1 can insert and remove the further apparatus from the socket 33.

In the exemplary illustrated embodiments the apparatus 1 comprises a mechanism 31. The mechanism 31 may comprise any means which may be configured to enable the user input device 15 to be moved between the closed position and the open position. The mechanism 31 may enable the user to move the user input device 15 between the closed position and the open position.

In some embodiments of the disclosure the mechanism 31 may also couple the user input device 15 to the apparatus 1. In some embodiments of the disclosure the mechanism 31 may couple the user input device 15 to the casing 17 of the apparatus 1. This may ensure that even when the user input device 15 is in the open configuration it remains securely attached to the apparatus 1. This may also enable input and output signals to be provided between the at least one processor 3 and the user input device 15 even when the user input device 15 is in the open configuration.

It is to be appreciated that the user input device 15 does not need to be directly coupled to the apparatus 1 or the casing of the apparatus 1. Any number or combination of intervening elements may be provided between the user input device 15 and the apparatus 1 or the casing 17 of the apparatus 1 including no intervening elements.

In the exemplary embodiment of FIGS. 3A and 3B the mechanism 31 comprises a flexible member 55. The flexible member 55 is attached to the back of the user input device 15 at one end and the casing 17 of the apparatus 1 at another end. The flexible member 55 may be configured to bend and/or stretch so that the user input device 15 may be moved between the closed position illustrated in FIG. 3A and the open position illustrated in FIG. 3B.

The user may be able to return the user input device 15 back to the closed position illustrated in FIG. 3A by bending the flexible member 55 back and pushing the user input device 15 back into the cavity 51 of the socket 33. When the apparatus is returned back to the closed position the flexible member 55 may be contained within the casing 17 of the apparatus 1 so that it is not visible when the user input device 15 is in the closed position.

In some embodiments of the disclosure the flexible member may comprise a conductive portion 56 to enable electrical signals to be transferred between the user input device 15 and the controller 4 of the apparatus 1. In some embodiments of the disclosure the flexible member 55 may enable the electrical signals to be transferred between the user input device 15 and the controller 4 of the apparatus 1 when the user input device 15 is in both the closed and the open positions.

Figure 4A:
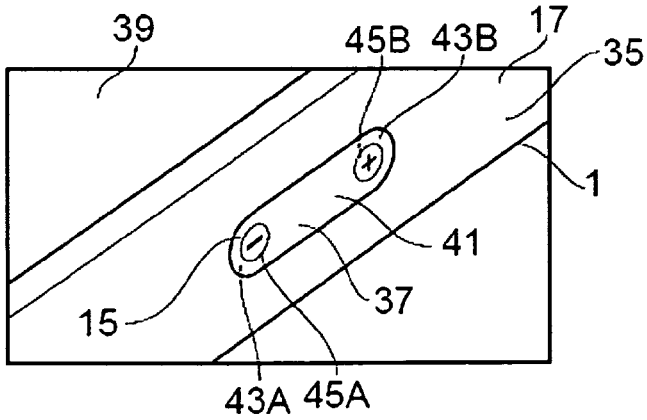
FIGS. 4A and 4B illustrate an apparatus according to a second exemplary embodiment of the disclosure.
Figure 4B:
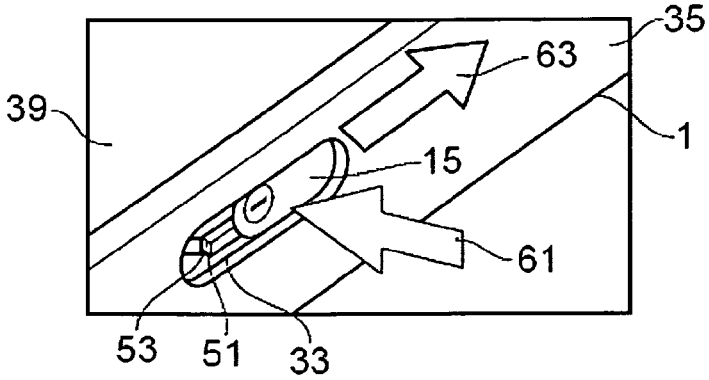

FIGS. 4A and 4B illustrate an apparatus 1 according to a second exemplary embodiment of the disclosure. The exemplary embodiment of FIGS. 4A and 4B is similar to the embodiment of FIGS. 3A and 3B except that a different mechanism 31 is provided to enable the user input device 15 to be moved between the open position and the closed position. Reference numerals which refer to the same or corresponding components are used in FIGS. 4A and 4B.

FIG. 4A illustrates the apparatus 1 with the user input device 15 in a closed position. As the socket 33 and mechanism are not visible when the user input device 15 is in the closed position the closed position of the second embodiment looks the same as the closed position of the first embodiment illustrated in FIG. 3A.

FIG. 4B illustrates the same apparatus 1 illustrated in FIG. 4A however in FIG. 4B the user input device 15 is being moved to an open position so that the socket 33 can be accessed by a user of the apparatus 1. In FIG. 4B the user input device 15 is illustrated part way between the closed position and the open position so that a part of the socket 33 can be seen in FIG. 4B.

The socket 33 illustrated in FIG. 4B may be the same as the socket illustrated in FIG. 3B. The socket 33 may comprise a cavity 51 within the casing 17 of the apparatus 1. where the cavity 51 may be configured to receive at least part of a further apparatus. The socket 33 may also comprise a connector 53 configured to couple to a further apparatus.

In the exemplary embodiment of FIGS. 4A and 4B the mechanism 31 comprises a sliding a mechanism. The sliding mechanism 31 is configured to enable the user input device 15 to slide in a direction parallel to the surface 35 of the casing 17. In such embodiments the casing 17 of the apparatus 1 may comprise a slide rail on the inside of the casing 17. As the slide rail is on the inside of the casing 17 it is not visible to the user of the apparatus 1 and so is not illustrated in FIGS. 4A and 4B.

In order to slide the user input device 15 along the rail the user may first provide a force in a direction which extends perpendicular to the surface 37 of the user input device 15 towards the inside of the casing 17 of the apparatus 1 as indicated by the arrow 61 in FIG. 4B. This may cause the user input device 15 to be pushed inside of the casing 17 of the apparatus 1.

The user may then provide a force which extends in a direction parallel to the surface 35 of the casing 17 as indicated by the arrow 63 in FIG. 4B. This may cause the user input device 15 to be moved to the side of the cavity 51 so that the socket 33 is accessible to the user of the apparatus 1.

The mechanism 31 may comprise guide rails within the casing of the apparatus 1 which are configured to guide the movement of the user input device 15 along a particular direction. In some embodiments of the disclosure the mechanism 31 may also comprise a compression spring or other means which may be configured to provide a restoring force to the user input device 15. The restoring force may be configured to push the user input device 15 back along the slide rail in a direction generally opposite to the direction in which the user has pushed the user input device 15. This may enable the user input device 15 to be automatically returned back to the closed position illustrated in FIG. 4A without any further action by the user.

Figure 5A:
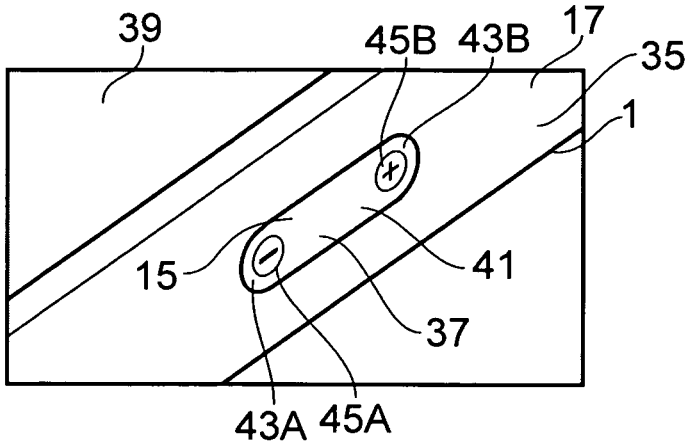
FIGS. 5A and 5B illustrate an apparatus according to a third exemplary embodiment of the disclosure.
Figure 5B:
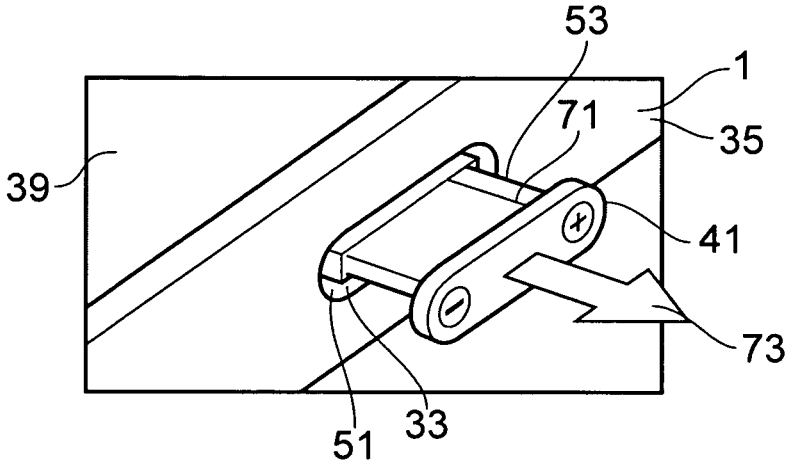

FIGS. 5A and 5B illustrate an apparatus according to a third exemplary embodiment of the disclosure. The exemplary embodiment illustrated in FIGS. 5A and 5B is similar to the embodiment of FIGS. 3A, 3B and 4A and 4B except that another different mechanism 31 is provided to enable the user input device 15 to be moved between the open position and the closed position. Reference numerals which refer to the same or corresponding components are used in FIGS. 5A and 5B.

FIG. 5A illustrates the apparatus 1 with the user input device 15 in a closed position. As the socket 33 and mechanism are not visible when the user input device 15 is in the closed position the closed position of the second embodiment looks the same as the closed position of the other embodiments illustrated in FIGS. 3A and 4A.

FIG. 5B illustrates the same apparatus 1 illustrated in FIG. 5A however in FIG. 5B the user input device 15 has been moved to an open configuration so that the socket 33 can be accessed to a user of the apparatus 1.

The socket 33 illustrated in FIG. 5B may be the same as the sockets 33 illustrated in FIGS. 3B and 4B. The socket 33 may comprise a cavity 51 within the casing 17 of the apparatus 1. where the cavity 51 may be configured to receive at least part of a further apparatus. The socket 33 may also comprise a connector 53 configured to couple to a further apparatus.

In FIGS. 5A and 5B the mechanism 31 for moving the user input device 15 also comprises a sliding mechanism. The sliding mechanism of FIGS. 5A and 5B is configured to enable the user input device 15 to slide in a direction perpendicular to the surface 35 of the casing 17 as is indicated by the arrow 73.

In such embodiments of the disclosure the sliding mechanism 31 may comprise a sliding tray 71 which is configured to slide outwards in response to user applying a force to the user input device 15. For example the user may push on the user input device 15 and this may actuate a compression spring which pushes the sliding tray 71 out of the casing 17 of the apparatus 1. The compression spring may push the sliding tray in a direction which extends perpendicular to the surface 35 of the casing 17 of the apparatus 1. Once the sliding tray 71 is fully open the further apparatus such as storage device or connector of a cable can be inserted into the socket 33. As the compression spring is located within the housing 17 of the apparatus 1 it is not visible to the user and so is not illustrated in FIGS. 5A and 5B.

The user may be able to return the user input device 15 to the closed position illustrated in FIG. 5A by pushing the sliding tray 71 back into the housing 17 of the apparatus 1. In embodiments of the disclosure where the mechanism 31 comprises a compression spring, this force applied by a user, may oppose the force applied by the compression spring.

In the exemplary embodiments described above and illustrated in FIGS. 3A, 3B, 4A, 4B, 5A and 5C the user input device 15 comprises a key 41. It is to be appreciated that other types of user input device 15 could be used in other embodiments of the disclosure.

It is also to be appreciated that different sized and shaped keys 41 or other types of user input device 15 may be used in other embodiments of the disclosure to cover different sized and shaped sockets 33. For example, in the above described embodiments the key 41 has an elongated shape and two actuatable portions. In other embodiments the key 41 may have a different shape or a different number of actuatable portions.

It is to be appreciated that the key 41 or other type of user input device 15 may be associated with any of the functions of the apparatus 1. In the above described embodiments the key 41 is configured to enable a user to control the volume of an audio output of an apparatus 1. In other embodiments of the disclosure the function of the key 41 or key 41 or other type of user input device 15 may depend on the mode of operation of the apparatus 1. For example, the key 41 or other type of user input device 15 may be associated with different functions in different modes of operation of the apparatus 1. In some exemplary embodiments of the disclosure the key 41 or other type of user input device 15 may enable the apparatus 1 to be turned on and off, may provide a shortcut to selected functions of the apparatus 1, may provide a locking function which disables or partially disables other user input devices of the apparatus 1 such as a touch sensitive display or any other suitable function or combination of functions.

In some embodiments of the disclosure the user input device 15 may be responsive to a pushing force both to move the user input device between the open and closed position and to enable a user input. For example, in FIG. 4B the user pushes the user input device 15 into the casing 17 of the apparatus 1 to move the user input device, but can also push the ends of the user input device 15 to control the volume of an audio output of the apparatus 1. In such embodiments the user input device 15 may be responsive to forces applied at different locations of the user input device 15 to perform different functions, so that if the user applies a force to an end of the user input device 15 a user input is made, but if a user applies a force to the middle of the user input device 15 the mechanism 31 enables the user input device to move. In some embodiments of the disclosure the user input device 15 may be configured to enable different functions to be performed in response to the magnitude of the force which is applied. For example, if the force is beneath a threshold a user input may be made, but if the force is above a threshold then the mechanism 31 may enable the user input device 15 to move.

Embodiments of the disclosure as described provide the benefit that they enable user input devices 15 to have a dual functionality of enabling control of a function of an apparatus 1 and also to provide a cover for a socket 33. This may be beneficial in small apparatus 1 where there is limited space available for user input devices 15 and sockets 33.

Embodiments of the disclosure may also improve the appearance of the apparatus 1 as they hide the cavities 51 of the sockets 33 to provide for a sleek continuous surface 35 of a casing 17.

Embodiments of the disclosure also provide that user input devices 15 can be provided in the surface 35 of a casing 17 which may make them easily accessible to a user of the apparatus 1.

Although embodiments of the present invention have been described in the preceding paragraphs with reference to various examples, it should be appreciated that modifications to the examples given can be made without departing from the scope of the invention as claimed. For example other type of mechanism 31 may be used to enable movement of the user input device 15. For example, in some embodiments of the disclosure the mechanism 31 may comprise a hinge 57 or other mechanism which enables the user input device 15 to rotate.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

a user input device comprising at least one actuatable portion; and a mechanism configured to enable the user input device to be moved between a first position and a second position wherein when the user input device is in the first position a socket is accessible by a user of the apparatus and when the user input device is in the second position the socket is not accessible by the user of the apparatus.

2. An apparatus as claimed in claim 1 wherein the user input device is configured to enable a user input to control at least one function of the apparatus.

3. An apparatus as claimed in claim 1 wherein the user input device comprises a key.

4. An apparatus as claimed in claim 1 wherein the mechanism configured to enable the user input device to be moved between a first position and a second position is configured to couple the user input device to the apparatus.

5. An apparatus as claimed in claim 1 wherein the mechanism configured to enable the user input device to be moved between a first position and a second position comprises a flexible member.

6. An apparatus as claimed in claim 1 wherein the mechanism configured to enable the user input device to be moved between a first position and a second position comprises a hinge.

7. An apparatus as claimed in claim 1 wherein the mechanism configured to enable the user input device to be moved between a first position and a second position comprises a sliding mechanism.

8. An apparatus as claimed in claim 1 wherein when the user input device is in the second position the user input device forms part of a surface of a casing of the apparatus.

9. An apparatus as claimed in claim 8 wherein the user input device forms a continuous surface with the casing of the apparatus.

10. An apparatus as claimed in claim 1 wherein the socket comprises a cavity configured to receive at least part of a further apparatus.

11. An apparatus as claimed in claim 10 wherein the further apparatus comprises a storage device.

12. An apparatus as claimed in claim 11 wherein the storage device comprises a memory card.

13. An apparatus as claimed in claim 10 wherein the further apparatus comprises a cable and the socket is configured to receive a connecting portion of the cable.

14. An apparatus as claimed in claim 3 wherein the key comprises a push-button configured to be depressable when a force is applied by a user.

15. An apparatus as claimed in claim 4 wherein the mechanism is configured to enable input and output signals to be provided between a controller of the apparatus and the user input device.

16. An apparatus as claimed in claim 1 wherein the mechanism comprises a conductive portion configured to enable electrical signals to be transferred between the user input device and a controller of the apparatus.

* * * * *